US011326386B2

(12) United States Patent
Peng et al.

(10) Patent No.: US 11,326,386 B2
(45) Date of Patent: May 10, 2022

(54) APPARATUS AND METHOD FOR CONTROLLING APERTURE MEMBERS IN A VEHICLE

(71) Applicant: JAGUAR LAND ROVER LIMITED, Coventry (GB)

(72) Inventors: George Peng, Warwickshire (GB); Luke Redfern, Warwickshire (GB)

(73) Assignee: Jaguar Land Rover Limited, Coventry (GB)

( * ) Notice: Subject to any disclaimer, the term of this patent is extended or adjusted under 35 U.S.C. 154(b) by 319 days.

(21) Appl. No.: 16/486,085

(22) PCT Filed: Feb. 6, 2018

(86) PCT No.: PCT/EP2018/052895
§ 371 (c)(1),
(2) Date: Aug. 14, 2019

(87) PCT Pub. No.: WO2018/149690
PCT Pub. Date: Aug. 23, 2018

(65) Prior Publication Data

US 2020/0002994 A1 Jan. 2, 2020

(30) Foreign Application Priority Data

Feb. 16, 2017 (GB) ..... 1702492

(51) Int. Cl.
*E05F 15/695* (2015.01)
*E05F 15/71* (2015.01)

(52) U.S. Cl.
CPC ..... *E05F 15/695* (2015.01); *E05F 15/71* (2015.01); *E05Y 2400/44* (2013.01);
(Continued)

(58) Field of Classification Search
CPC .... E05F 15/695; E05F 15/71; E05Y 2400/44; E05Y 2800/422; E05Y 2900/542; E05Y 2900/55
See application file for complete search history.

(56) References Cited

U.S. PATENT DOCUMENTS 5,955,854 A 9/1999 Zhang et al.
2008/0120175 A1 5/2008 Doering
(Continued)

FOREIGN PATENT DOCUMENTS

CN 102806831 A 12/2012
CN 106223771 A 12/2016
(Continued)

OTHER PUBLICATIONS

Search and Examination Report, GB1702492.8, dated Aug. 27, 2017.
(Continued)

*Primary Examiner* — Mussa A Shaawat
(74) *Attorney, Agent, or Firm* — McCoy Russell LLP

(57) ABSTRACT

Embodiments of the present invention provide a controller, a system, a method and a vehicle, to receive one or more user inputs from one or more user input units; receive one or more vehicle condition inputs from one or more vehicle condition sensor units; determine if an open position of a aperture member of a vehicle is likely to cause buffeting; select an optimisation strategy from a plurality of optimisation strategies in dependence on the one or more user inputs and/or the one or more vehicle condition inputs, wherein each of the plurality of optimisation strategy comprises different instructions to determine one or more positions for at least one aperture member; and generate an output for the one or more aperture member positioning
(Continued)

units to move at least one aperture member based on the selected optimisation strategy.

20 Claims, 5 Drawing Sheets

(52) U.S. Cl.
CPC ... *E05Y 2800/422* (2013.01); *E05Y 2900/542* (2013.01); *E05Y 2900/55* (2013.01)

(56) References Cited

U.S. PATENT DOCUMENTS

2009/0295197 A1* 12/2009 Zabel ..... B60H 1/00407 296/208
2013/0268163 A1* 10/2013 Comfort ..... B60J 7/04 701/49
2015/0048764 A1* 2/2015 Binfet ..... E05F 15/695 318/283
2016/0090773 A1 3/2016 Whippler
2016/0263977 A1* 9/2016 Kalliomaki ..... B60J 1/20
2017/0145729 A1* 5/2017 Hernandez-Urbina ..... E05F 15/695

FOREIGN PATENT DOCUMENTS

DE 19633188 C1 7/1997
DE 10222029 B3 2/2004
DE 10340979 A1 3/2004
DE 102007001007 A1 7/2008
DE 102007028311 A1 1/2009

OTHER PUBLICATIONS

Search and Examination Report, GB1702492.8, dated Aug. 7, 2018.
International Search Report and Written Opinion, PCT/EP2018/052895, dated Apr. 9, 2018.

* cited by examiner

APPARATUS AND METHOD FOR CONTROLLING APERTURE MEMBERS IN A VEHICLE

CROSS-REFERENCE TO RELATED APPLICATIONS

This application is a 371 of International Application No. PCT/EP2018/052895, filed Feb. 6, 2018, which claims priority to GB Patent Application 1702492.8, filed Feb. 16, 2017, the contents of both of which are incorporated by reference herein in their entirety.

TECHNICAL FIELD

The present disclosure relates to an apparatus and method for controlling aperture members in a vehicle, Aspects of the invention relate to a controller, to a system, to a method, and to a vehicle.

BACKGROUND

Buffeting is a phenomenon that occurs in vehicles that is travelling at speed, where an aperture member of the vehicle is open (e.g. windows or sunroof). Airflow around the vehicle passes over the open aperture causing a mass of air to oscillate within the vehicle cabin. In this circumstance the vehicle cabin functions as a volume in a Helmholtz resonator. The oscillation of air in the vehicle cabin results in pressure fluctuations at audible frequencies, meaning occupants of the vehicle experience a loud noise associated with buffeting. The noise of buffeting can reach very high levels (for example 120 dB), and can become uncomfortable for the occupants of the vehicle.

One method to reduce buffeting is to provide a window with a comfort stop, whereby a window is opened to a pre-programmed distance by the user. A comfort stop may typically cause the window to open about 70 to 100 mm for example where it will automatically stop. If the user requires the window to be opened beyond the comfort stop, then usually further operation or a long press of the window switch will cause the window to continue opening.

Another method to reduce buffeting is to automatically close a vehicle aperture (for example by moving an aperture member such as a window or sunroof glass) as vehicle speed increases.

However, such systems can be seen as a hindrance by the user when increased ventilation is desired.

It is an object of embodiments of the invention to at least mitigate one or more of the problems of the prior art and to provide improvements generally.

SUMMARY OF THE INVENTION

Aspects and embodiments of the invention provide a controller, a system, a vehicle and a method as claimed in any one of the accompanying claims.

According to an aspect of the invention, there is provided a controller for controlling at least one vehicle aperture member. The controller is configured to: receive one or more user inputs from one or more user input units; to receive one or more vehicle condition inputs from one or more vehicle condition sensing units; select an optimisation strategy from a plurality of optimisation strategies in dependence on the one or more user inputs and/or the one or more vehicle condition inputs, wherein each of the optimisation strategies comprises different instructions for determining positions for the at least one aperture member; and generate an output to the one or more aperture member positioning units to move at least one aperture member in dependence on the selected optimisation strategy.

By providing a controller that selects an optimisation strategy, and moving an aperture member in dependence on the optimisation strategy, the ease of aperture member positioning can improved. For example, a user can select a strategy to suit their requirements rather than adjusting each aperture member or relying on one mode of automated aperture member repositioning.

In an embodiment, the controller for controlling at least one vehicle aperture member may comprise control electrical circuitry. The control electrical circuitry may comprise one or more processors, one or more input units, one or more output units and one or more non-transitory or transitory computer readable medium.

In embodiments, the controller or one or more processors of the control electrical circuitry may execute software to perform any of the functions or methods described herein. In embodiments, software may be executed to receive one or more user inputs from one or more user input units; receive one or more vehicle condition inputs from one or more vehicle condition sensor units; select an optimisation strategy from a plurality of optimisation strategies in dependence on the one or more user inputs and/or the one or more vehicle condition inputs; and generate an output for the one or more aperture member positioning units to move at least one aperture member in dependence on the selected optimisation strategy.

In embodiments, more than one optimisation strategies may be selected from the plurality of optimisation strategies.

In an embodiment, the controller is arranged to select an optimisation strategy whereby the at least one aperture member is moved to minimise vehicle fuel consumption and to maintain a user selectable level of ventilation.

In embodiments, the controller may generate an output to move at least one aperture member in dependence on the selected optimisation strategy so that the at least one aperture member is moved to minimise fuel consumption whilst maintaining a user set level of ventilation. This may further improve usability.

In embodiments, the controller may generate an output to move at least one aperture member in dependence on the selected optimisation strategy so that the at least one aperture member is moved to minimise buffeting in the vehicle cabin and maintain user set level of ventilation. This may further improve usability.

In embodiments, the controller may generate an output to move at least one aperture member in dependence on the optimisation strategy so that the aperture member is moved to prevent buffeting within a cabin of the vehicle from exceeding a threshold. This may further improve usability. In embodiments, the threshold may be determined in dependence on selected optimisation strategy.

In embodiments, the controller may generate an output to move a first aperture member in dependence on one or more user inputs, and may generate an output to move a second aperture member in dependence on the selected optimisation strategy and/or the position of the first aperture member. This may further improve usability.

In embodiments, the controller may record user preferences and may modify at least one of the plurality of optimisation strategies in dependence on one or more recorded user preferences. The controller may record the one or more user preferences to a non-transitory computer readable medium. This may further improve accuracy of the system thereby improving usability.

In embodiments, at least one of the plurality of optimisation strategies may be modified using machine learning.

According to an aspect of the invention, there is provided a system comprising: a controller as described herein; at least one user input unit; at least one aperture member positioning unit; and at least one sensor unit for determining a condition of the vehicle.

In embodiments, the at least one sensing unit comprises a sensor to measure a property of the airflow within a vehicle cabin. This may further improve accuracy of the system thereby improving usability.

In embodiments, the at least one sensing unit comprises a sensor to determine the position of at least one aperture member.

According to another aspect of the invention, there is provided a vehicle comprising a system or controller as described herein.

According to a further aspect of the invention, there is provided a method of preventing buffeting in a vehicle comprising: selecting an optimisation strategy from a plurality of optimisation strategies; and moving at least one aperture member of the vehicle in dependence on the selected optimisation strategy, wherein each of the optimisation strategies comprises different instructions for determining positions for the at least one aperture member. The method may comprise preventing buffeting in a cabin of the vehicle.

In embodiments, at least one input may be received from a user input unit; and/or at least one input may be received from a sensor unit; and an optimisation strategy may be selected in dependence on the input from the user input unit and/or on the input from the sensor unit.

In embodiments, at least one vehicle condition sensing unit may be used to measure a parameter of the vehicle; and at least one aperture member may be moved in dependence on the measured parameter of the vehicle and on the selected optimisation strategy. This may further improve usability for the user.

In embodiments, at least one input from a sensor unit may be received; and at least one aperture member may be moved in dependence on the at least one input from the at least one sensor unit and on the selected optimisation strategy.

The method may comprise selecting the optimisation strategy so as to minimise vehicle fuel consumption and to maintain a user set level of ventilation within the vehicle.

In embodiments, the at least one aperture member may be moved in dependence on the selected optimisation strategy to minimise fuel consumption and maintain user set level of ventilation. This may further improve usability for the user.

The method may comprise selecting the optimisation strategy so as to minimise buffeting within a cabin of the vehicle and to maintain a user set level of ventilation within the vehicle.

In embodiments, the at least one aperture member may be moved in dependence on the selected optimisation strategy to minimise buffeting in a cabin of the vehicle and maintain a user set level of ventilation. This may further improve usability for the user.

The method may comprise selecting the optimisation strategy so as to prevent buffeting within the vehicle from exceeding a threshold.

In embodiments, the at least one aperture member may be moved in dependence on the selected optimisation strategy moved to prevent buffeting within the vehicle cabin from exceeding a threshold. In embodiments, the threshold may be determined in dependence on the selected optimisation strategy.

In embodiments, moving a first aperture member may be performed in dependence on one or more user inputs and moving a second aperture member performed in dependence on the selected optimisation strategy and/or the position of the first aperture member.

In embodiments, moving the at least one aperture member may comprise: selecting an aperture member to move in dependence on the selected optimisation strategy; determining the extent to which the selected aperture member is moved, in dependence on the selected optimisation strategy.

BRIEF DESCRIPTION OF THE DRAWINGS

Embodiments of the invention will now be described by way of example only, with reference to the accompanying figures, in which.

DETAILED DESCRIPTION

Figure 1:
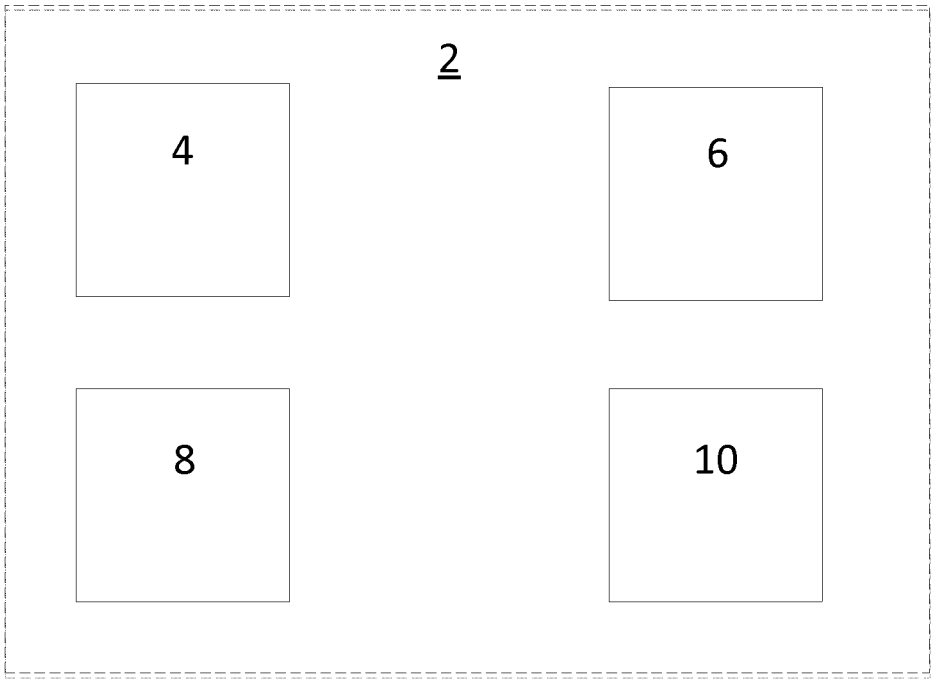
FIG. 1 is a diagram of an embodiment system.

As used herein, "vehicle" may include but is not limited to automobiles.

As used herein, "vehicle cabin" may refer to the interior of the vehicle where the passengers or driver may be located.

As used herein, "vehicle speed" may refer to the rate at which the vehicle is moving.

As used herein, "lateral side of the vehicle" may include the left and the right sides of the vehicle in relation to the front, which is orientated in the direction of travel of the vehicle.

As used herein, "user" may include drivers, passengers or any occupant of the vehicle.

As used herein, "user input" may include any input provided by a user. This may include but is not limited to using a switch to open or close an aperture member by altering the position of an aperture member, for example.

As used herein, "buffeting" may include any undesirable airflow within a vehicle cabin. This may include but is not limited to the following examples: air flow vortices or pressure fluctuations that occur when a vehicle has an open aperture member and is travelling at speed.

As used herein, "preventing buffeting" or "minimising buffeting" may include reducing the magnitude or extent of buffeting in the vehicle cabin, either partially or completely. This may include but is not limited to reducing buffeting so that the noise associated with buffeting is below a specified sound pressure level, for example, below 90 dB, or below 85 dB, or below 80 dB.

As used herein, "aperture member" may include any member that can be moved to present an opening between the inside of a vehicle cabin and outside of the vehicle. In a closed state the aperture member may be moved to provide an aperture. An aperture member may include but is not limited to the following examples: an openable vehicle window glass or an openable sunroof glass.

As used herein, "front aperture member" may include any aperture member positioned at the front portion of a vehicle cabin. When used in relation to a car or similar vehicle, it may refer to the aperture members near the front seats of the vehicle cabin. Similarly, "rear aperture member", as used herein, may include any aperture member positioned towards the rear seats of the vehicle cabin. When used in relation to a car or similar vehicle, it may refer to the aperture members near the rear seats of the vehicle cabin.

As used herein, "moving an aperture member" may include repositioning an aperture member, to either increase or decrease the size of opening of the respective aperture.

As used herein, "closing an aperture member" may include reducing the size of the opening of an aperture. In a non-limiting example, where an aperture member is a car window arranged to open by moving downward, closing an aperture member may also comprise raising the aperture member. Similarly, "opening an aperture member" as used herein, may include increasing the size of the opening of an aperture. In a non-limiting example, where an aperture member is a car window arranged to open by moving downward, opening an aperture member may also comprise lowering the aperture member.

As used herein, "ventilation" refers to the amount of airflow entering the vehicle cabin through an open aperture member.

As used herein, "user set level of ventilation" refers to the approximate amount of airflow a user is receiving from adjusting aperture members to positions to achieve that amount of airflow.

As used herein, "airflow within the vehicle cabin" includes airflow passing in or out of the cabin, or moving or oscillating within the cabin.

As used herein, "machine learning" refers to the process of recoding user behaviour and adapting software to identified user preferences.

As used herein, "monitoring" includes receiving input from a sensor. This may include the following non-limiting examples: continuous monitoring, sampling at a regular interval, or sampling after an event, e.g. 30 seconds after a window has been moved.

As used herein, "aperture member positioning unit" may include any apparatus capable of changing the position of an aperture member. This may include but is not limited to a drive system for an electric window.

Referring to FIG. 1, a controller 10 is shown, the controller 10 is operable to receive an input from one or more user input units 6, to receive one or more vehicle condition inputs from one or more vehicle condition sensor units 4, and to generate one or more outputs for one or more aperture member positioning units 8. Embodiment controllers will be discussed. The controller 10 is operable for selection of an optimisation strategy from a plurality of optimisation strategies, wherein each of the plurality of optimisation strategy comprises different instructions to determine positions for the at least one aperture member. In embodiments, the instructions of an optimisation strategy may comprise control logic. The controller 10 may use an optimisation strategy to determine which aperture members are to be moved, the extent they are to be moved by and the conditions under which they are moved. The optimisation strategies may be used by the controller 10 to generate an output in dependence on inputs from the vehicle condition sensing units 4 and/or the one or more user input units 6.

Each of the plurality of optimisation strategies may prioritize different outcomes, thus the selection of different optimisation strategies may result different aperture member positions being determined under identical inputs from the one or more vehicle condition sensing units 4 and/or the one or more user input units 6. Thus, different optimisation strategies may be considered as different instructions for the controller 10 to achieve different aperture positioning outcomes.

In embodiments, each of the optimisation strategies may determine aperture position using different method and optionally using different inputs.

The controller may be comprised as part of a system 2, also shown in FIG. 1.

The system 2 comprises at least one user input unit 6. The user input 6 is operable to receive an input. In a non-limiting example, the input may, for example, be received from a user. In a non-limiting example, the input may be received from a user who desires the position of at least one aperture member to be altered. Embodiment user input units will be discussed. In embodiments, the controller 10 is operable to receive an input from the user input unit 6 for selection of an optimisation strategy.

The system 2 comprises at least one aperture member positioning unit 8. The aperture member positioning unit is operable to change the position of at least one aperture member. Embodiment aperture member positioning units will be discussed. In embodiments, the controller 10 is operable to generate an output to the aperture member positioning unit to move at least one aperture member based on the selected optimisation strategy.

In embodiments, the system 2 comprises at least one sensor unit 4 for measuring a parameter or condition of a vehicle as defined herein. Embodiment sensors will be discussed.

The system 2 may also comprise a power supply (not shown) for supply of electrical energy to the controller 10, and in other embodiments, any of the aperture member positioning unit 8, the user input 6 and/or the at least one sensor 4 unit. The power supply may comprise a connection to an electrochemical cell, for example a vehicle battery, and may comprise means for conditioning the power supply to be suitable for the aforementioned components.

Figure 2:
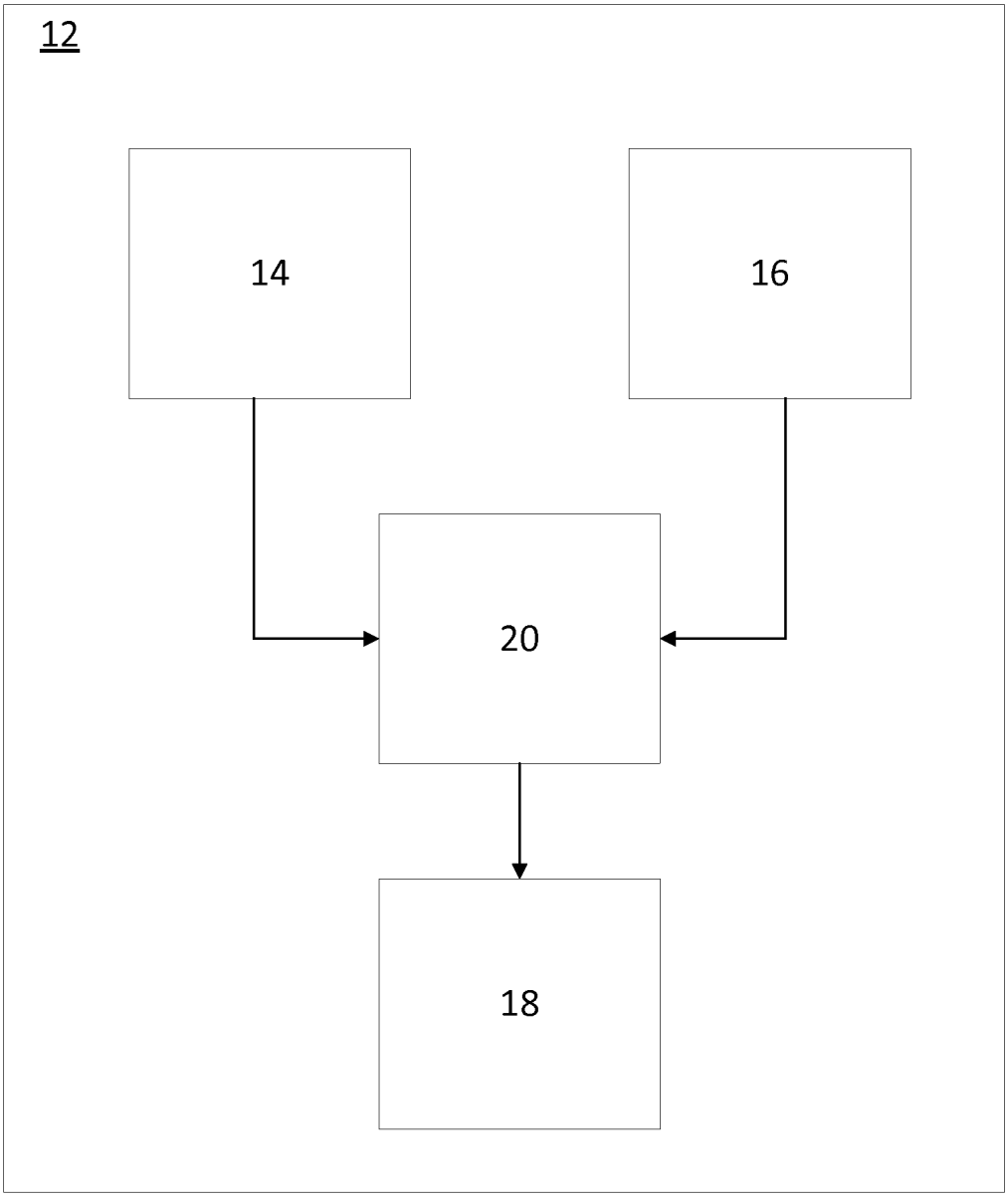
FIG. 2 is a diagram of an embodiment.

Referring to FIG. 2, a controller 20 for controlling aperture members in a vehicle is shown. The controller is also shown as part of a system 12. System 12 comprises at least one vehicle condition sensing unit 14 to measure a parameter or condition of a vehicle. System 12 comprises at least one user input unit 16 which generates an output following receipt of an input from a user. The system 12 comprises at least one aperture member positioning unit 18.

The controller 20 is configured to receive one or more inputs from the user input unit 16. This may occur for example when a user desiring to move an aperture member operates the user input unit 16. The controller 20 is also configured to receive one or more inputs from one or more vehicle condition sensing units 14. The controller 20 is operable to select an optimisation strategy from a plurality of optimisation strategies. In embodiments, the optimisation strategies may be stored on the one or more non-transitory or transitory computer readable mediums of the controller 20. The controller 20 uses the one or more inputs from the sensor unit 14, and/or inputs from the one or more inputs from the vehicle condition sensing units for selection of the optimisation strategy. The controller 20 is configured to generate an output to an aperture member positioning unit 18 for moving of an aperture member. The output may be in the form of electrical energy or an electrical signal, for example, which may cause the aperture member positioning unit 18 to move an aperture member. The output is based on the selected optimisation strategy. Non-limiting examples of moving an aperture member based on the optimisation strategy may include moving an aperture member to a positional limit, closing an aperture member to reduce buffeting, opening a second aperture member to reduce buffeting and opening an aperture member to increase ventilation.

Figure 3:
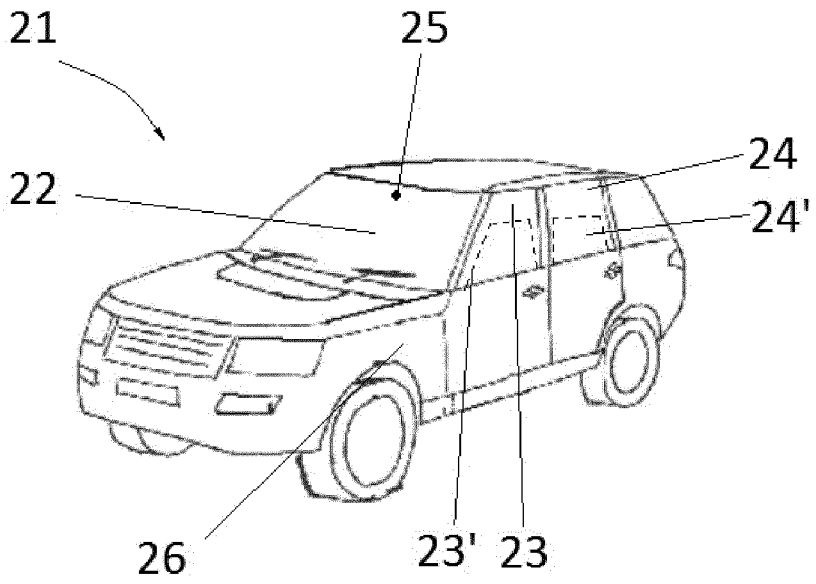
FIG. 3 is a diagram of an embodiment vehicle.

Referring to FIG. 3, a vehicle is shown, the vehicle 21 comprising a vehicle cabin 22, having aperture members 23, 24, a vehicle sensor unit 25. Also shown in FIG. 3 is a side 26 of vehicle 21. The vehicle comprises a system or controller as described herein for controlling the aperture members.

Also shown in FIG. 3 is a non-limiting representation of aperture member position limits 23', 24' for aperture members 23, 24.

Figure 4:
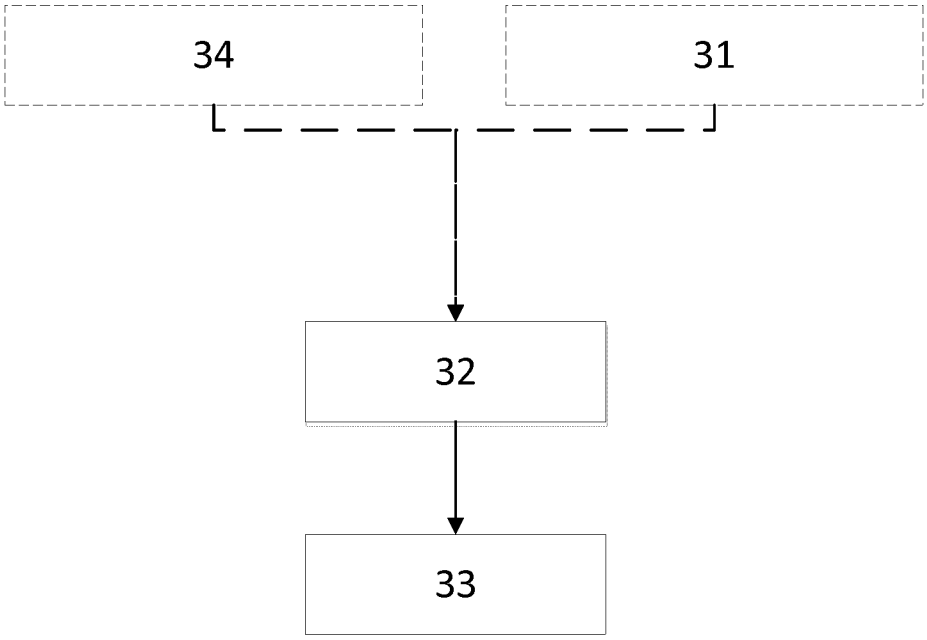
FIG. 4 is a flow diagram of an embodiment.

Referring to FIG. 4, a method is shown 30 comprising a step of selecting an optimisation strategy from a plurality of optimisation strategies 32, and moving at least one aperture member based on the selected optimisation strategy 33. The controller may comprise or access a plurality of optimisation strategies stored on a computer readable medium associated with the controller 20, for example stored on a memory. Each optimisation strategy may comprise a different set of instructions. The controller may use an optimisation strategy to determine which aperture members are to be moved, the extent they are to be moved by and the conditions under which they are moved. The optimisation strategies may be used by the controller to generate an output in dependence on inputs from the vehicle condition sensing units and/or the one or more user inputs.

In embodiments, selection of the optimisation strategy 32 may be based on the input from at least one sensor unit 31. This may comprise a controller 20 receiving an input from at least one sensor 16.

The selection of the optimisation strategy 32 may alternatively be based on the input from one or more user input units 34. This may comprise receipt of an input from a user input unit 34 by the controller 20 for selection of an optimisation strategy. The user input unit 34 may, for example, comprise a visual display unit and/or an array of buttons or any input unit as described herein. In embodiments, the controller 20 may comprise software executable to receive an input from a user input unit for the selection of an optimisation strategy 32.

Alternatively, step 32 may comprise selecting an optimisation strategy based on both the input from a user input unit 34 and from the sensing unit 31. The optimisation strategies may be stored on a computer readable medium associated with the controller 20. The selected optimisation strategy is then used to determine the moving at least one aperture member 33.

In embodiments, more than one optimisation strategies may be selected from the plurality of optimisation strategies. The controller 20 may then move aperture members based on the more than one selected optimisation strategies.

In embodiments, where at least one input is received from one or more vehicle condition sensor units 14; at least one aperture member may be moved 33 based on the at least one input from the at least one sensor unit 14, and on the selected optimisation strategy. For example, the optimisation strategy may contain at least one pre-set threshold against which the measured parameter is compared. The result of the comparison may determine if an aperture member is to be moved, how far an aperture member is to be moved or may be used when moving as part of a closed loop process, for example.

Moving of an aperture member may be initiated upon receipt of user input, or may be initiated without user input, i.e. automatically. If moving of no aperture members is required, monitoring of the measured parameter may occur. Optionally, following moving of an aperture member 33, monitoring of the measured parameter may occur.

In embodiments, the at least one aperture member is moved 33 based on the selected optimisation strategy so that the at least one aperture member is moved to minimise fuel consumption and maintain user set level of ventilation. The optimisation strategy may comprise instructions to the controller 20 to generate an output to aperture member positioning unit 18 to move one or more aperture members from a user requested position to one to favour a reduction in fuel consumption. For example, this may be at the expense of a user set level of ventilation or cabin buffeting levels. Or it may comprise moving one or more aperture members to reduce fuel consumption and to maintain user set levels of ventilation or cabin buffeting. For example, where a user has opened one aperture member a large amount, the controller 20 may generate an output to aperture member positioning unit 18 to move other aperture members to be open a small amount and to partially close the open aperture member. That way, ventilation may be maintained and fuel economy improved by making the vehicle more streamlined. In a non-limiting example, the controller 20 may generate an output to at least partially close an open aperture member when the speed of the vehicle is high, that way, excessive fuel consumption can be minimised.

In embodiments, the at least one aperture member is moved 33 based on the selected optimisation strategy, so that the at least one aperture member is moved to minimise buffeting in the vehicle cabin and to maintain a user set level of ventilation. For example, a user may select an optimisation strategy stored on a computer readable medium, accessed by the controller 20. The optimisation strategy may comprise instructions to the controller 20 to generate an output to aperture member positioning unit 18 to move one or more aperture members from a user requested position, to one where buffeting is reduced. This position may at the expense of the user set levels of ventilation or moving may be to maintain a user set level of ventilation. In a non-limiting example, a user may operate a user input unit to open an aperture member. The controller 20 will receive an input from the user input unit 16 and generate an output to an aperture member positioning unit 18 to open an aperture as requested by the user. If the open aperture causes buffeting in the vehicle cabin 22 to exceed an unacceptable level, the controller 20 may generate an output to aperture member positioning units 18 to partially close the aperture member or open a second aperture member to reduce buffeting whilst maintaining ventilation.

In embodiments, the at least one aperture member is moved 33 based on the selected optimisation strategies so that the at least one aperture member is moved to prevent buffeting within the vehicle cabin 22 from exceeding a threshold. For example, a user may select an optimisation strategy stored on a computer readable medium, accessed by the controller 20. The optimisation strategy may comprise instructions to the controller 20 to generate an output to aperture member positioning unit 18 to move one or more aperture members from a user set position to prevent buffeting from exceeding a threshold. The controller 20 may compare input from the sensor unit 14 to a threshold stored on computer readable medium. In a non-limiting example, a user may operate a user input unit 16 to open an aperture. The controller 20 will receive an input from the user input unit 16 and generate an output to an aperture member positioning unit 18 to open an aperture as requested by the user. If the open aperture causes buffeting in the vehicle cabin to exceed an unacceptable level (e.g. the vehicle speeds up) or the user desires to open an aperture member beyond a position where buffeting will exceed an unacceptable level, the controller 20 may generate an output to aperture member positioning units 18 to partially close the aperture or open a second aperture to prevent buffeting.

In embodiments, the threshold may be based on the selected optimisation strategy. For example, the selected optimisation strategy may correspond to one or more pre-set thresholds, which may be stored on a computer readable medium.

Moving an aperture member may occur based on the input received from the sensor unit 16. For example, where the sensor unit is a speed sensor, repositioning may occur where the vehicle speed exceeds a threshold amount. The aperture members that are moved and the amount they are moved may also be determined based on the measured speed, for example.

In embodiments, where a first aperture member is moved by a user, operating the user input unit 16, a second aperture member may be moved based on the optimisation strategy and or position of the first aperture member. In embodiments, the second aperture member may be moved based on the input from the sensing unit.

In an exemplary embodiment, a user may select an optimisation strategy via an input unit 16 from a list comprising a first optimisation strategy that prioritizes fuel economy and a second optimisation strategy that prioritizes user ventilation. In such an embodiment, were the user to select the first operating strategy with an aperture member in a user set open position, the controller 10 may open and close the aperture member as the vehicle speed changes speed. This strategy may maintain some ventilation without significant adverse effects on fuel consumption compared to other strategies. Alternatively, were the user to select the second optimisation strategy, the controller 10 may open and close a second aperture depending on vehicle speed. The opening of a second window may provide a more effective strategy for reducing buffeting and maintaining ventilation than the first strategy, however, the opening of multiple windows may have a more adverse effect on fuel consumption than the first strategy.

In embodiments, the controller may be configured to record user preferences to the non-transitory computer readable medium and modify at least one of the plurality of optimisation strategies based on recorded user preferences. User preferences may be recorded by the controller 20. For example, preferred positions or interventions made by the user following moving of an aperture member by the controller 20 may be identified by the controller. These may be analysed by the controller and used to change the instructions of the optimisation strategy selected at that time. For example, where an optimisation strategy is used, where the user repeatedly alters the position of a moved aperture member, the optimisation strategy may be modified by changing any pre-set aperture member position limits or thresholds associated with the optimisation strategy to correspond to the user set positions. In embodiments, at least one of the plurality of optimisation strategies is modified using machine learning. For example, the optimisation strategies can be modified based on the chosen user strategies and occupancy pattern, e.g. the vehicle is predominantly occupied by only a driver and operated with a strategy that prioritizes fuel efficiency.

The at least one vehicle condition sensor 4, 14 may comprise multiple sensors. The at least one sensing unit may comprise a sensor for measuring a parameter within a vehicle cabin, and may comprise any number of additional sensors. Additional sensors may include speed sensors for measuring vehicle speed; temperature for measuring temperature in the vehicle; air speed sensors for detecting or measuring flow of air in or around a vehicle cabin; microphone for detecting noise in a vehicle cabin; vehicle occupancy sensors for detecting user occupancy of a vehicle, aperture member position sensors for detecting current position of at least one aperture member.

Where the at least one sensor comprises an acoustic sensor, this may be arranged (not shown) to provide an input to the controller 20. The controller 20 may process the signal from the acoustic sensor to isolate a noise of interest. In a non-limiting example, the controller 20 comprise filters (e.g. a Fourier or band pass filter) or other appropriate algorithms to isolate a noise of interest. In a non-limiting example the controller 20 may comprise algorithms to determine the level of noise caused by buffeting in the vehicle cabin. The system may be configured to provide closed or open loop control for moving the aperture member using the acoustic sensor, or for determining aperture member position limits. The aperture member may be moved until the noise of interest measured by the sensor reaches a level, e.g. drops below a threshold, for example. A threshold may be set at a comfort threshold below which is deemed comfortable and above which is deemed uncomfortable for the user. Likewise, an aperture member may be moved in response to a user input via the user input unit until the noise measured reaches a level, e.g. reaches a threshold. The term "acoustic sensor" may include but is not limited to any known pressure sensor, vibration sensor or sensor that can be used to sense acoustic noise.

Where the at least one vehicle condition sensing unit includes a position sensor, this may be arranged (not shown) to provide an input to the controller 20 that corresponds to aperture member position. The system may be configured to provide a closed or open loop for moving the aperture member using the position sensor. The aperture member position may be used by the controller 20 as part determining an aperture member position limit or as part of moving an aperture member.

Where the at least one sensor includes a position sensor, this may be arranged (not shown) to provide an input to the controller 20 that corresponds to aperture member position. This may be configured to provide a closed or open loop for moving the aperture member. The aperture member position may be used by the controller 20 as part of determining an aperture member position limit or as part of moving an aperture member, for example.

The user input may comprise one or more units for allowing a user input for positioning an aperture member to be received. This may, for example, comprise one or more switches located in a vehicle. The switches may configured to allow input for opening or closing an aperture member or aperture members, for example. The user input may comprise a vehicle user interface comprising buttons, voice command facility or a touch screen for user input. The user interface may include one or more of the following: buttons, such as a joystick button or press button; joystick; LEDs; graphic or character LDCs; graphical screen with touch sensing and/or screen edge buttons; or other like devices. Alternative user input units are also known in the art and may be considered suitable as part of the present invention.

An aperture member positioning unit 18 may comprise an actuator and may comprise any associated mechanism for moving an aperture member. For example, an aperture member positioning unit 18 may comprise an electric motor.

The electric motor may for example be connected to a drive gear aperture member regulator in which the motor is connected via a gear system to an arm configured to rotate by the motor, whereby rotation of the arm causes an aperture member to move. In an alternative example, the aperture member may be connected to a cable system to which an aperture member is mounted, so that movement of the cable by a motor causes the aperture member to move. The output from a controller 20 may cause the motor of an aperture member positioning unit 18 to move. Alternative aperture member positioning units are also known in the art and may be considered suitable as part of the present invention.

In embodiment variations the controller 10, 20 may be a control electrical circuit, which may control the sensor 4, 14, input unit 6, 16 and aperture member positioning unit 8, 18 by means of electrically operated switches, which control the electrical energy supplied from the power supply to various sub-components of the system 2, 12. The electrically operated switches can comprise various transistors such as a MOSFET and the like.

As used herein, "electrical circuit" includes circuitry operable to provide a control function to the various units defined herein including: the at least one aperture member positioning unit 8, 18, sensor unit 4, 14 or input unit 6, 16. A controller or control electrical circuit may be located on a vehicle, and may be distributed in multiple locations on a vehicle. The electrical circuitry may also be distributed on another component in communication with the circuit of the system, which may include a networked-based, including as a remote server, or cloud-based computer or portable electronic device, which may include a mobile phone. An electrical circuit may comprise electrical components known to the skilled person, including passive components, e.g. combinations of transistors, transformers, resistors, capacitors or the like. The electrical circuitry may be partially embodied on a processor, including as an ASIC, microcontroller, FPGA, microprocessor, state machine or the like. The processor can include a computer program stored on a memory and/or programmable logic, for execution of a process. The memory can be a computer-readable medium. The process may include controlling the position of aperture members in a vehicle.

Figure 5:
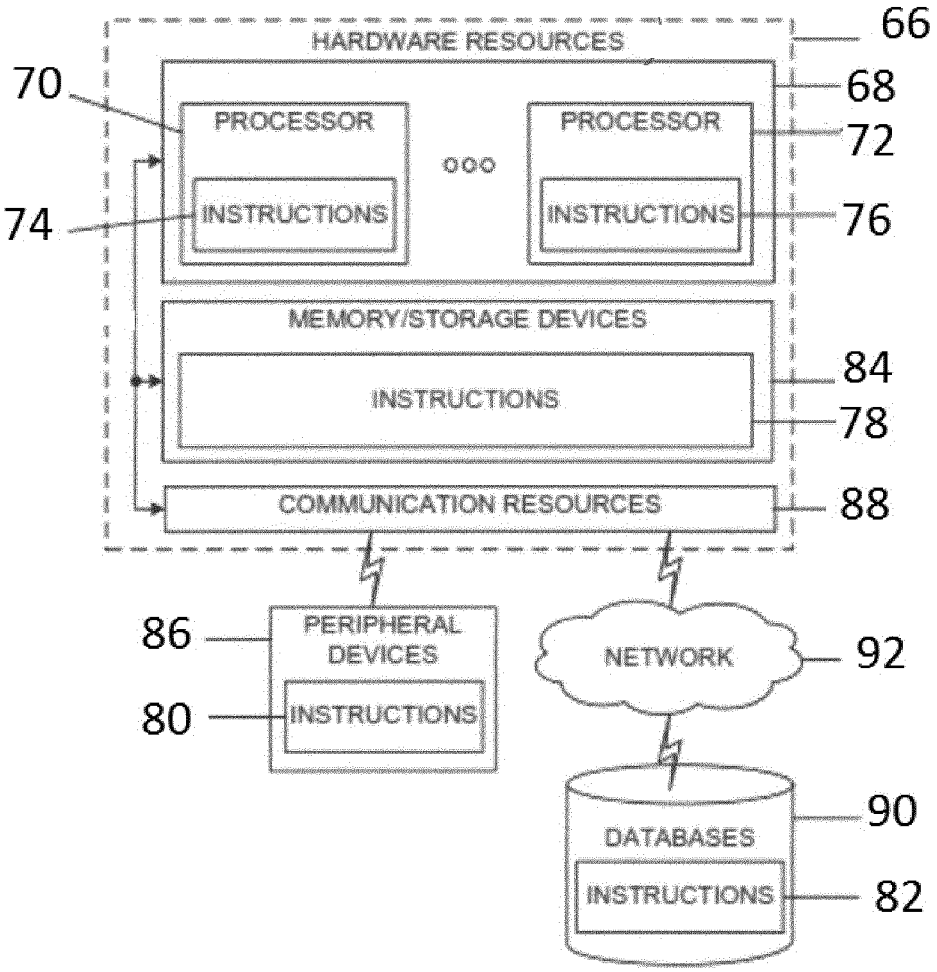
FIG. 5 is a diagram of an embodiment of the controller.

Referring to FIG. 5, an embodiment electrical circuit which may be included in the controller 10, 20 is shown, which comprises hardware resources 66. The hardware resources 66 comprise processing resources 68. The processor resources 68 comprise one or more processors 70, 72 adapted to execute machine readable instructions 74, 76, 78, 80, 82. The instructions may be for implementing a processes for receiving an input from the user input unit 16, sensing units 18, processing such inputs, determining an aperture member position limit, determining the need to move an aperture member, generating an output signal to an aperture member positioning unit or other like process. In embodiments the instructions 74, 76 are arranged on the one or more processors 70, 72. In embodiments the instructions 78 are arranged on separate memory/storage devices 84. In embodiments, instructions 80 may be arranged on peripheral devices 86, which may include I.A. sensor units, vehicle consoles, positioning units, which are in communication with the control electrical circuit by means of communication resources 88. In embodiments, the instructions 82 are arranged on a remote database 90 (including a network-based or cloud-based system), which is in communication with the control electrical circuit by means of communication resources 88 over a computer network 92. The memory/storage devices can be implemented and computer-readable medium as defined herein.

It will be appreciated that embodiments of the present invention can be realised in the form of hardware, software or a combination of hardware and software. Any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are embodiments of machine-readable storage that are suitable for storing a program or programs that, when executed, implement embodiments of the present invention. Accordingly, embodiments provide a program comprising code for implementing a system or method as claimed in any preceding claim and a machine readable storage storing such a program. Still further, embodiments of the present invention may be conveyed electronically via any medium such as a communication signal carried over a wired or wireless connection and embodiments suitably encompass the same.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed. The claims should not be construed to cover merely the foregoing embodiments, but also any embodiments which fall within the scope of the claims.

The invention claimed is:

1. A controller for controlling at least one vehicle aperture member, the controller configured to:

receive one or more user inputs from one or more user input units;

receive one or more vehicle condition inputs from one or more vehicle condition sensor units;

select an optimization strategy from a plurality of optimization strategies based at least in part on one or both of the one or more user inputs and the one or more vehicle condition inputs, wherein each of the plurality of optimization strategies comprises different instructions for determining positions for the at least one aperture member such that the selection of different optimization strategies results in different aperture member positions being determined under identical inputs from either or both of the one or more vehicle condition sensor units and the one or more user input units;

generate an output for one or more aperture member positioning units to move at least one aperture member based at least in part on the selected optimization strategy; and in one of the optimization strategies, and responsive to a user opening one aperture member a large amount, generate an output to move other aperture members to be open a small amount and to partially close the open aperture member.

2. A controller according to claim 1, wherein the controller is arranged to select the optimization strategy such that the at least one aperture member is moved to minimise vehicle fuel consumption and maintain a user selectable level of ventilation.

3. A controller according to claim 1, wherein the controller is arranged to select the optimization strategy such that the at least one aperture member is moved to minimise buffeting and maintain a user selectable level of ventilation.

4. A controller according to claim 1, wherein the controller is arranged to generate an output to move at least one aperture member based at least in part on the optimization strategy such that the at least one aperture member is moved to prevent buffeting within a cabin of the vehicle from exceeding a threshold.

5. A controller according to claim 4, wherein the threshold is determined based at least in part on the selected optimization strategy.

6. A controller according to claim 1, wherein the controller is arranged to generate an output to move a first aperture member based at least in part on one or more user inputs and to generate an output to move a second aperture member based at least in part on one or both of the selected optimization strategy and the position of the first aperture member.

7. A controller according to claim 1, wherein the controller is arranged to record one or more user preferences and to modify at least one of the plurality of optimization strategies based at least in part on the one or more recorded user preferences.

8. A controller according to claim 7 wherein at least one of the plurality of optimization strategies is modified using machine learning.

9. A system comprising:

the controller of claim 1;

at least one user input unit;

at least one aperture member positioning unit; and at least one sensing unit for determining at least one condition of a vehicle.

10. A system according to claim 9 wherein the at least one sensing unit comprises a sensor arranged to measure a property of the airflow within a vehicle cabin.

11. A system according to claim 9 wherein the at least one sensing unit comprises a sensor arranged to determine the position of the at least one aperture member.

12. A vehicle comprising the system of claim 9.

13. A method of controlling at least one vehicle aperture member, the method comprising:

receiving one or more user input from one or more user input units;

receiving one or more vehicle condition inputs from one or more vehicle condition sensor units;

selecting an optimization strategy from a plurality of optimization strategies based at least in part on one or both of the one or more user inputs and the one or more vehicle condition inputs, wherein each of the plurality of optimization strategy comprises different instructions for determining positions for at least one aperture member of the vehicle such that the selection of different optimization strategies results in different aperture member positions being determined under identical inputs from either or both of the one or more vehicle condition sensor units and the one or more user input units;

moving at least one aperture member of the vehicle based at least in part on the selected optimization strategy; and in one of the optimization strategies, and responsive to a user opening one aperture member a large amount, generating an output to move other aperture members to be open a small amount and to partially close the open aperture member.

14. A method according to claim 13, further comprising:

receiving at least one input from a sensing unit; and moving at least one aperture member based at least in part on the at least one input from the at least one sensing unit and on the selected optimization strategy.

15. A method according to claim 13, comprising moving the at least one aperture member based at least in part on the selected optimization strategy to minimise fuel consumption and maintain a user selectable level of ventilation.

16. A method according to claim 13, comprising moving the at least one aperture member based at least in part on the selected optimization strategy to minimise buffeting in a cabin of the vehicle and to maintain a user selectable level of ventilation.

17. A method according to claim 13, comprising moving the at least one aperture member based at least in part on the selected optimization strategy to prevent buffeting within a cabin of the vehicle from exceeding a threshold.

18. A method according to claim 17, wherein the threshold is based at least in part on a selected optimization strategy.

19. A method according to claim 13, comprising moving a first aperture member based at least in part on one or more user inputs and moving a second aperture member based at least in part on one or both of the selected optimization strategy and the position of the first aperture member.

20. A method according to claim 13, wherein moving the at least one aperture member comprises:

selecting an aperture member to move based at least in part on the selected optimization strategy;

determining the extent to which the selected aperture member is to be moved based at least in part on the selected optimization strategy.

* * * * *